US008997621B1

(12) United States Patent
Dater et al.

(10) Patent No.: US 8,997,621 B1
(45) Date of Patent: Apr. 7, 2015

(54) QUICK MOUNT ADAPTER FOR FIREARM SUPPRESSOR

(71) Applicant: Gemini Technologies, Eagle, ID (US)

(72) Inventors: Philip H. Dater, Boise, ID (US); Nolan Blake Young, Eagle, ID (US)

(73) Assignee: Gemini Technologies, Eagle, ID (US)

( * ) Notice: Subject to any disclaimer, the term of this patent is extended or adjusted under 35 U.S.C. 154(b) by 0 days.

(21) Appl. No.: 14/473,103

(22) Filed: Aug. 29, 2014

(51) Int. Cl.
*F41A 21/30* (2006.01)
*F41A 21/32* (2006.01)

(52) U.S. Cl.
CPC ..... *F41A 21/32* (2013.01); *F41A 21/30* (2013.01)

(58) Field of Classification Search
CPC ..... F41A 21/34; F41A 21/30; F41A 21/36; F41A 21/325
USPC ..... 89/14.3, 14.4, 14.5, 14.2, 14.1; 181/223; 42/1.06
See application file for complete search history.

(56) References Cited

U.S. PATENT DOCUMENTS

| | | | | |
|---|---|---|---|---|
| 2,372,315 | A * | 3/1945 | Catron | 89/14.3 |
| 4,893,426 | A * | 1/1990 | Bixler | 42/75.01 |
| 5,433,133 | A * | 7/1995 | La France | 89/14.2 |
| 5,685,102 | A * | 11/1997 | Latka | 42/85 |
| 7,588,122 | B2 * | 9/2009 | Brittingham | 181/223 |
| 7,677,150 | B2 * | 3/2010 | Dater et al. | 89/14.05 |
| 7,891,282 | B1 * | 2/2011 | DeGroat | 89/14.4 |
| 7,905,171 | B1 * | 3/2011 | Brittingham | 89/36.08 |
| 8,091,462 | B2 * | 1/2012 | Dueck et al. | 89/14.05 |
| 8,162,100 | B2 * | 4/2012 | Shults et al. | 181/223 |
| 8,186,261 | B2 * | 5/2012 | McNeill et al. | 89/14.3 |
| 8,210,087 | B2 * | 7/2012 | Latka | 89/14.3 |
| 8,272,306 | B1 * | 9/2012 | Smith | 89/14.4 |
| 8,387,299 | B1 * | 3/2013 | Brittingham et al. | 42/90 |
| 8,424,441 | B2 * | 4/2013 | Brittingham et al. | 89/14.4 |
| 8,439,155 | B2 * | 5/2013 | Shults et al. | 181/223 |
| 8,490,535 | B1 * | 7/2013 | Moore et al. | 89/14.2 |
| 8,714,301 | B2 * | 5/2014 | Shults | 181/223 |
| 8,807,005 | B2 * | 8/2014 | Moss et al. | 89/14.1 |
| 2007/0095198 | A1 * | 5/2007 | Dater et al. | 89/14.2 |
| 2009/0050403 | A1 * | 2/2009 | Brittingham | 181/223 |
| 2010/0229712 | A1 * | 9/2010 | Graham | 89/14.2 |
| 2011/0036233 | A1 * | 2/2011 | DeGroat | 89/14.4 |
| 2011/0252952 | A1 * | 10/2011 | McNeill et al. | 89/14.3 |
| 2012/0279381 | A1 * | 11/2012 | Landolt | 89/14.4 |
| 2013/0312592 | A1 * | 11/2013 | Storrs et al. | 89/14.1 |
| 2013/0340313 | A1 * | 12/2013 | Myers et al. | 42/90 |
| 2014/0020976 | A1 * | 1/2014 | Shults | 181/223 |
| 2014/0020977 | A1 * | 1/2014 | Shults | 181/223 |
| 2014/0360807 | A1 * | 12/2014 | McKenzie | 181/223 |

* cited by examiner

*Primary Examiner* — Bret Hayes
*Assistant Examiner* — Joshua Freeman
(74) *Attorney, Agent, or Firm* — Parsons Behle & Latimer

(57) ABSTRACT

A quick mount adapter for a firearm that includes a cylindrical adapter base having a first portion, a second portion, and a central bore. The central bore includes a first bore having a smaller diameter and a second bore having a larger diameter. A portion of the second bore is threaded and an exterior portion of the housing includes threads. The quick mount adapter includes a biasing mechanism and a washer being positioned within the second bore of the adapter base. A collar having a central bore and an internal locking profile in the central bore is threaded into the adapter base to retain the washer and biasing mechanism within the second bore. The quick mount adapter includes a spacer comprising a hollow cylindrical housing having a top surface, a central opening in the top surface, and a plurality of annular openings positioned around the central opening.

23 Claims, 7 Drawing Sheets

QUICK MOUNT ADAPTER FOR FIREARM SUPPRESSOR

BACKGROUND

1. Field of the Disclosure

The embodiments described herein relate to a quick mount adapter for a firearm suppressor.

2. Description of the Related Art

An adapter may be used to quickly attach various accessories to the muzzle end of the barrel of a firearm. For example, an adapter is commonly be used to connect a suppressor to the end of the barrel, which may be used to reduce the noise made during the discharge of a firearm. During the firing of the firearm, gas from the discharge of the ammunition often exits the muzzle break, which deposits material, such as carbon, present in the discharge gas. The buildup of carbon and other deposits between the barrel and the adapter can be problematic. For example, the buildup of carbon can make it to extremely difficult to separate the barrel from the adapter.

Accordingly, there is a need to provide an adapter that may reduce or eliminate the buildup of carbon and other deposits between the barrel and adapter. Other drawbacks and disadvantages of present suppressor systems also exist.

SUMMARY

The present disclosure is directed to a quick mount adapter for a firearm suppressor. The quick mount adapted is configured to minimize carbon buildup between the muzzle of a firearm and the quick mount adapter. The quick mount adapter may address some of the problems and disadvantages discussed above.

One embodiment is a quick mount adapter for a firearm comprising an adapter based comprising a cylindrical housing having an upper portion and a lower portion, the upper portion having an upper end with an opening in the upper end and a lower portion having a lower end with an opening in the lower end and a cavity within the lower portion of the housing. A portion of the cavity having threads and an exterior portion of the upper portion having threads. The cylindrical housing having an interface between the upper portion and the lower portion, the interface forming an internal shoulder within the cavity. The quick mount adapter comprises a wave spring having a top surface, a bottom surface, and a central opening, the wave spring being positioned within the cavity of the adapter base, the top surface of the wave spring being positioned adjacent the internal shoulder within the cavity. The quick mount adapter comprises a washer having a top surface, a bottom surface, and a central opening, the washer being positioned within the cavity of the adapter base, the top surface of the washer being positioned adjacent the bottom surface of the wave spring. The quick mount adapter comprises a collar having a top surface, a bottom surface, a central opening, and an internal locking profile, the collar having threads on an external surface between the top surface and the bottom surface, the threads of the collar engaging the threads in the cavity of the adapter base wherein a portion of the collar is positioned within the cavity.

The quick mount adapter may include a spacer positioned on the upper portion of the adapter base. Alternatively, the upper portion of the adapter base may be formed with an integral spacer. The spacer comprising a cylindrical housing having a top surface and a bottom surface, a central opening in the top surface, a plurality of annular openings positioned around the central opening, and an opening in the bottom surface of the cylindrical housing defining a cavity within the cylindrical housing. The opening of the bottom surface of the spacer may have a larger diameter than the diameter of the central opening in the top surface of the spacer. The central opening of the top surface of the space may define an annular portion of the cavity within the spacer.

The opening in the upper end of the adapter base may have a smaller diameter than the diameter of the opening in the lower end of the adapter base. The top surface of the adapter base may include an upper external shoulder and the interface may define a lower external shoulder. The bottom surface of the spacer may be positioned on the upper external shoulder of the adapter base. The threads on the exterior portion of the upper portion of the adapter base may be below the upper external shoulder. The locking profile may be configured to selectively connect the adapter base to a locking profile on a barrel. The central opening of the collar may comprise a first notch and a second notch. The first notch and the second notch may be positioned approximately 180 degrees apart around the central opening of the collar.

The internal locking profile of the collar may comprise a first internal shoulder, a first path, a first stop, a first recess, a second internal shoulder, a second stop, a second path, and a second recess. The first path may connect the first notch to the first recess and the second path may connect the second notch to the second recess. The first recess may be positioned between the first internal shoulder and the first stop and the second recess may be positioned between the second internal shoulder and the second stop. The first internal shoulder and the second stop may each be positioned adjacent the first notch and the second internal shoulder and the first stop may each be positioned adjacent the second notch. The wave spring may bias the washer towards the locking profile of the collar to selectively retain a locking profile on a barrel within the first and second recess of the locking profile of the collar. The washer may be used to depress the wave spring against the internal shoulder of the adapter base to permit movement of a locking profile on a barrel along the first and second paths of the locking profile of the collar.

One embodiment is a suppressor system for a firearm comprising an adapter base comprising a cylindrical housing having an upper portion and a lower portion, the upper portion having an upper end with an opening in the upper end and the lower portion having a lower end with an opening in the lower end and a cavity within the lower portion of the housing, a portion of the cavity having threads and an exterior portion of the upper portion having threads, and the cylindrical housing having an interface between the upper portion and the lower portion, the interface forming an internal shoulder within the cavity. The system comprises a wave spring having a top surface, a bottom surface, and a central opening, the wave spring being positioned within the cavity of the adapter base, the wave spring configured to have the top surface positioned adjacent the internal shoulder within the cavity. The system comprising a washing having a top surface, a bottom surface, and a central opening, the washing being configured to be positioned within the cavity of the adapter base with the top surface of the washer being positioned adjacent to the bottom surface of the wave spring. The system comprising a collar having a top surface, a bottom surface, a central opening, and an internal locking profile, the collar having threads on an external surface between the top surface and the bottom surface, the threads of the collar configured to engage the threads in the cavity of the adapter base to position a portion of the collar within the cavity of the adapter base. The system comprising a suppressor housing having a first end and a second end, the first end adapted to be connected to the threads on the exterior portion of the adapter base, the suppressor housing being adapted to suppress a noise during the discharge of a firearm. The system comprising a spacer configured to be positioned on an upper exterior shoulder of the adapter base within the suppressor housing. Alternatively, the spacer may be formed as a portion of the upper portion of the adapter base. The spacer comprising a cylindrical housing having a top surface and a bottom surface, a central opening in the top surface, a plurality of annular openings positioned around the central opening, and an opening in the bottom surface of the cylindrical housing defining a cavity within the cylindrical housing. The opening of the bottom surface of the spacer having a larger diameter than the diameter of the central opening in the top surface of the spacer. The central opening of the top surface of the spacer defining an annular portion of the cavity within the spacer.

The interface between the upper portion and the lower portion of the adapter base may form a lower external shoulder and the first end of the suppressor housing may abut against the lower external shoulder. The central opening of the collar may comprise a first notch and a second notch. The internal locking profile of the collar may comprise a first internal shoulder, a first path, a first stop, a first recess, a second internal shoulder, a second stop, a second path, and a second recess. The first path may connect the first notch to the first recess and the second path may connect the second notch to the second recess. The first recess may be positioned between the first internal shoulder and the first stop and the second recess may be positioned between the second internal shoulder and the second stop. The washer may be used to depress the wave spring against the internal shoulder of the adapter base to permit a first locking lug of a barrel to move along the first path from the first notch to the first recess and to permit a second locking lug of the barrel to move along the second path from the second notch to the second recess. The first stop may prevent the first lug from moving beyond the first recess and the second lug may prevent the second lug from moving beyond the second recess. The wave spring may bias the bottom surface of the washer against the first and second lugs to selectively retain the first and second lugs within the first and second recesses.

One embodiment is a quick mount adapter for a firearm comprising an adapter base comprising a cylindrical housing having a first portion, a second portion, and a central bore comprising a first bore through the first portion of the housing and a second bore through the second portion of the housing, the first bore having a smaller inner diameter than the second bore, a portion of the second bore having threads and an exterior portion of the first portion of the housing having threads, and an internal shoulder formed at an interface between the first bore and the second bore. The quick mount adapter comprises a biasing mechanism being positioned within the second bore of the adapter base. The quick mount adapter comprises a washer positioned within the second bore, the biasing mechanism being positioned between the washer and the internal shoulder. The quick mount adapter comprises a collar having a central bore and an internal locking profile in the central bore, a portion of the collar being threaded into the second bore to retain the washer and biasing mechanism within the second bore between the collar and the internal shoulder. The quick mount adapter comprises a spacer comprising a hollow cylindrical housing having a top surface, a central opening in the top surface, and a plurality of annular openings positioned around the central opening. The biasing mechanism may be a wave spring. The spacer may be a portion of the first portion of the adapter base.

Figure 1:
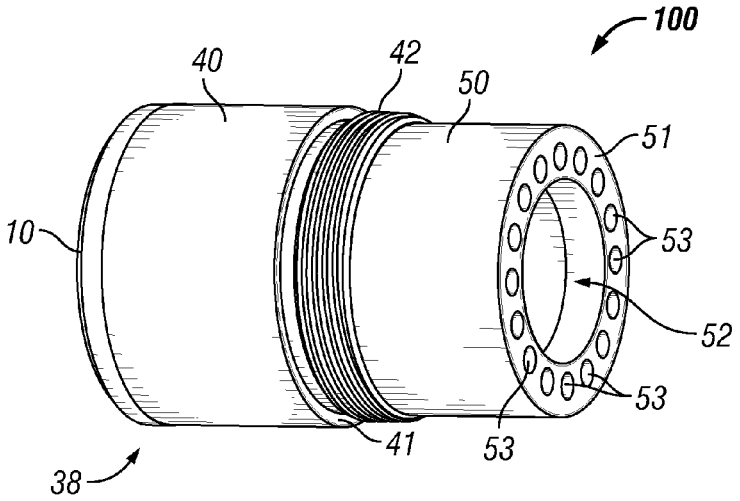
FIG. 1 shows a front isometric view of one embodiment of a quick mount adapter.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the invention as defined by the appended claims.

DETAILED DESCRIPTION

FIG. 1 shows an embodiment of a quick mount adapter assembly 100. The quick mount adapter 100 includes an adapter base 40 that is comprised of a first, or upper, portion 39 (shown in FIG. 2) and a second, or lower, portion 38. A threaded a collar 10 is threaded into the lower portion 38 and selectively retains a washer 20 and biasing mechanism within a cavity (shown in FIG. 8) of the lower portion 38 of the adapter base 40. The biasing mechanism may be various devices that bias the washer 20 away from an internal shoulder 48 (shown in FIG. 8), as would be appreciated by one of ordinary skill in the art. Preferably, the biasing mechanism may be a wave spring 30 which provides the requisite spring force in a relatively small lateral distance. Previously, it has not been known to use a wave spring 30 in a quick mount adapter 100.

The upper portion 39 of the adapter base 40 includes threads 42 that permit the connection of a firearm suppressor 300 (shown in FIG. 13) to the quick mount adapter 100. An interface between the lower portion 38 and the upper portion 39 of the adapter base 40 may form a lower external shoulder 41 upon which a portion of the suppressor 300 may abut or engage when secured to the quick mount adapter 100. A spacer 50 may be positioned on an external upper shoulder 43 (shown in FIG. 2). The spacer 50 may be an integral component of the adapter base 40 instead of being a separate component as would be appreciated by one of ordinary skill in the art having the benefit of this disclosure. The spacer 50 includes a central bore 52 in a top surface 51 as well as a plurality of apertures 53 in top surface 51 around the central bore 52. As discussed herein, the plurality of apertures in combination with an annular cavity or space 58 (shown in FIG. 9) within the spacer 50 may prevent carbon build up within the adapter 100 due to repeated discharging of a firearm.

Figure 2:
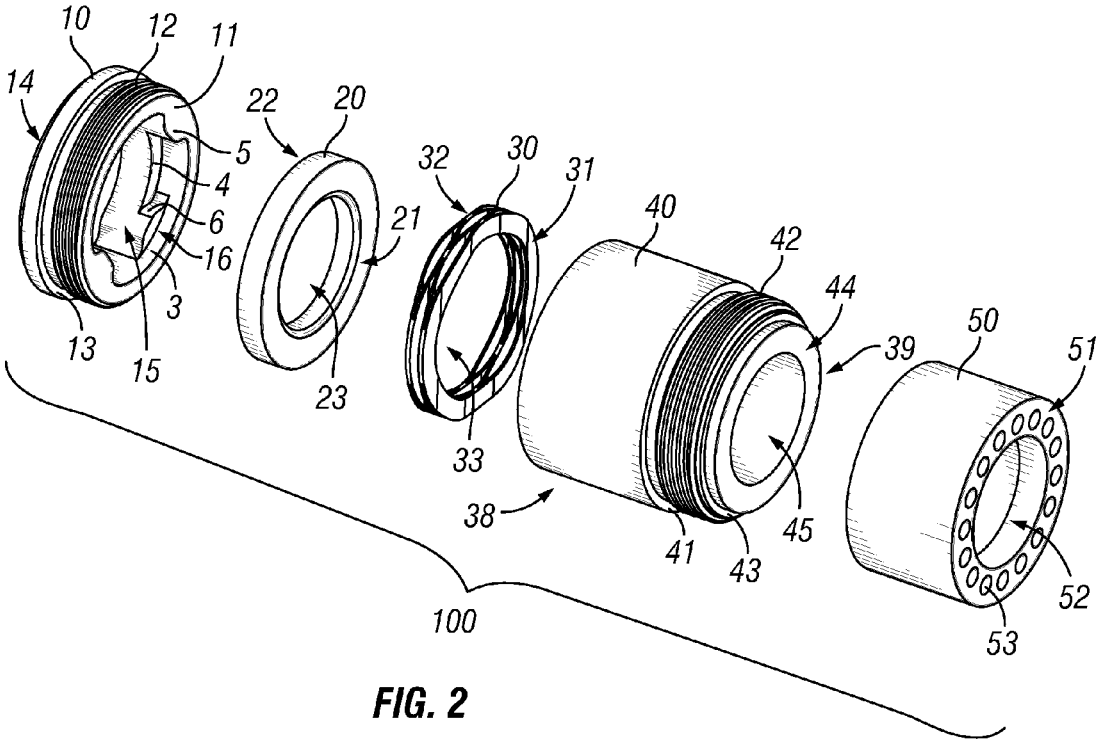
FIG. 2 shows an exploded view of an embodiment of a quick mount adapter.

FIG. 2 shows an exploded view of a quick mount assembly 100 that includes a collar 10, washer 20, wave spring 30, adapter base 40, and spacer 50. The collar 100 includes a first, or top, surface 11, a second, or bottom, surface 14, and a central bore 15. A described herein, the central bore 15 of the collar 10 includes a locking profile 16 that permits the selective locking of a barrel within locking tabs within the quick mount adapter 100. The locking profile 16 may include two paths 3 and 19, two internal shoulders 6 and 9, two internal stops 5 and 8, and two recesses 4 and 7 positioned between the shoulders 6 and 9 and stops 5 and 8. The two paths 3 and 19 permit the travel of the barrel locking tabs 217 and 218 (shown in FIG. 11) to move into the recesses 4 and 7 between the internal shoulders and stops that selectively retain the locking tabs 217 and 218 in combination with the washer 20 and wave spring 30, as detailed herein. The collar 10 includes external threads 12 that are configured to mate with the internal threads 49 (shown in FIG. 8) of the adapter base 40. The collar 10 may include an external shoulder 13 that engages the lower end 46 (shown in FIG. 8) of the adapter base 40 when the collar 10 is threaded into the adapter base 40. The collar 10 is configured to retain the washer 20 and the wave spring 30 within the lower portion 38 of the adapter base 40.

The washer 20 includes a top or upper surface 21 and a bottom or lower surface 22 with a central bore or aperture 23. The central bore 23 permits the insertion of a portion of a barrel 200 (shown in FIG. 11) through the washer 20. The bottom surface 22 of the washer 20 is positioned adjacent the top surface 11 of the collar 10 and the top surface 21 of the washer 20 is positioned adjacent the bottom surface 32 of the wave spring 30 when assembled together to form the quick mount adapter 100. The wave spring 30 includes a top or upper surface 31, a bottom or lower surface 32, and central bore or aperture 33. The central bore 33 permits the insertion of a portion of a barrel 200 through the wave spring 30. The top surface 31 of the wave spring 30 is positioned adjacent an internal shoulder 48 in the lower portion 38 of the adapter base 40 when assembled as the quick mount adapter 100.

The wave spring 30 biases the bottom surface 22 of the washer 20 against the top surface 11 of the collar 10. When a barrel 200 with locking lugs 217 and 218 is inserted into the quick mount adapter the barrel lugs 217 and 218 push against the bottom surface 22 of the washer 20 and compress the wave spring 30 against the internal shoulder 48 until the lugs 217 may be rotated along paths 3 and 19. The lugs 217 and 218 are rotated along the paths 3 and 19 until they drop into recesses 4 and 7. Stops 5 and 8 prevent the rotation of the lugs 217 and 218 beyond the recesses 4 and 7. Once the lugs 217 and 218 are positioned within the recesses 4 and 7, the wave spring 30 pushes the washer 20 back against the collar 10 to selectively retain the lugs 217 and 218 within the recesses 4 and 7 along with internal shoulders 6 and 9 and internal stops 5 and 8. The barrel 200 may be removed from the quick mount adapter 100 by pushing the barrel 200 upward to compress the wave spring 30 with the washer 20 and move lugs 217 and 218 above shoulders 6 and 9 rotating the lugs 217 and 218 back along the paths 3 and 19.

The adapter base 40 is a cylindrical housing having an upper portion 39 and a lower portion 38. An internal shoulder 48 in the lower portion 38 in combination with the collar 10 threaded into an opening 47 in the lower portion 38 retains the washer 20 and wave spring 30 within the lower portion 38. The upper portion 39 of the adapter base 40 includes an upper surface 44 having an opening 45, which permits a portion of the barrel 200 to pass through the upper portion 39 of the adapter base 40. The upper portion 39 of the adapter base 40 includes external threads 42, which permits the connection of the quick connector adapter 100 to a suppressor 300. The upper portion 39 also may include an upper external shoulder 43 upon which the spacer 50 may be positioned.

The spacer 50 is positioned on top of the adapter base 40 and may be a hollow cylinder having a central opening 52 in the top surface 51. The spacer 50 includes a plurality of holes 53 in the top surface 51 positioned around the central opening 52. The plurality of holes 53 permits communication to the hollow interior of the spacer 50 and aids in the prevention of carbon buildup between the quick mount adapter 100 and the barrel 200 due to repeated discharges of the firearm connected to the barrel 200.

Figure 3:
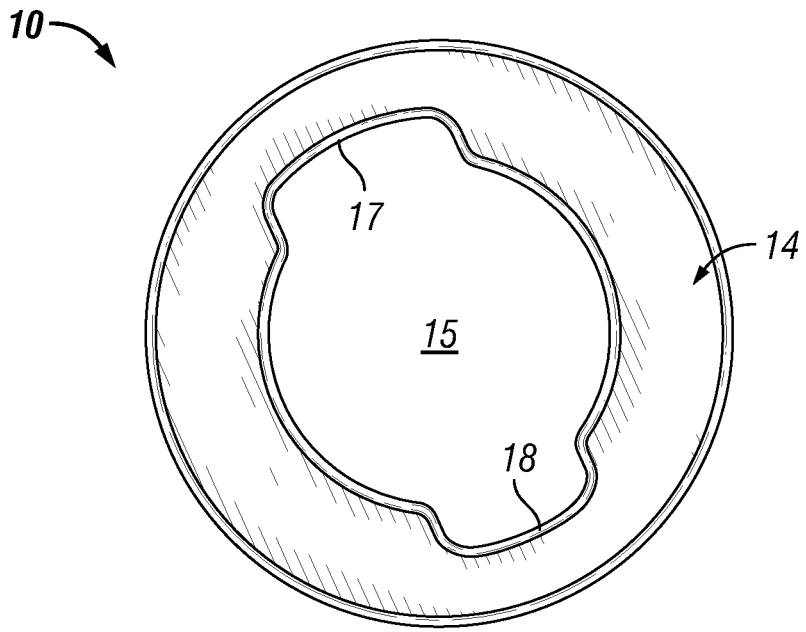
FIG. 3 shows a bottom view of one embodiment of a collar of a quick mount adapter.

FIG. 3 shows a bottom view of an embodiment of a collar 10. The bottom surface 14 of the collar 10 may include a central bore 15 having a first notch 17 and a second notch 18. The central bore 15, first notch 17, and second notch 18 are configured to permit the insertion of a barrel 200 having locking lugs 217 and 218 into the collar 10. The shapes of the first and second notches 17 and 18 may not be identical. For example the first notch 17 may correspond to the shape of locking lug 217, which may differ in shape of locking lug 218 to require a single orientation in the insertion of the barrel 200 into the collar 10.

Figure 4:
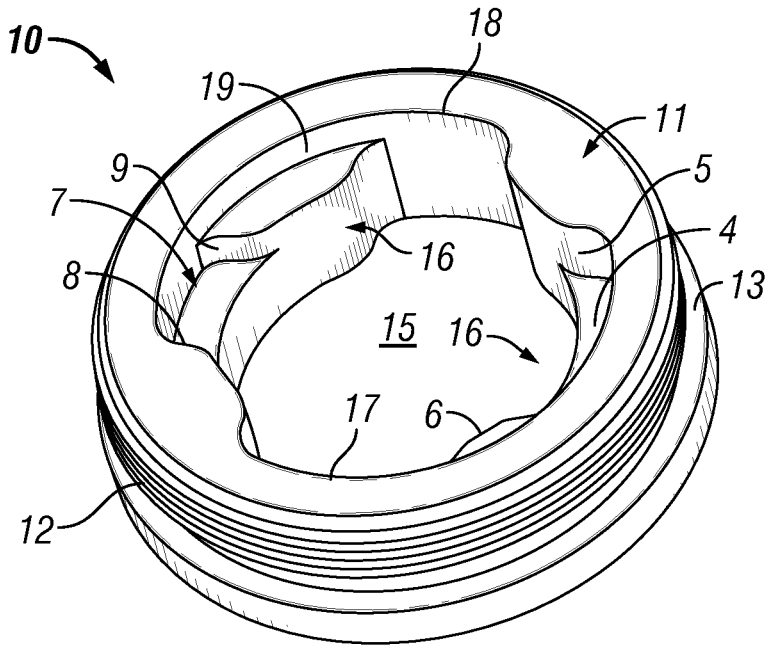
FIG. 4 shows an isometric top view of one embodiment of a collar of a quick mount adapter.

FIG. 4 shows a top view an embodiment of a collar 10 that may be used in a quick mount adapter 100. The collar 10 includes a top surface 11 with a central bore 15 having a first notch 17 and a second notch 18 as discussed in regards to FIG. 3. A portion of the exterior of the collar 10 may include threads 12 to permit insertion of a portion of the collar 10 into the lower portion 38 of the base adapter 40. The collar 10 may include an external shoulder 13 configured to engage a bottom surface 46 of the base adapter 40.

The bore 15 of the collar 10 may include two substantially identical locking profiles 16 on each side of the bore 15. Locking lug 218 may enter the bore 15 at a first notch 18 in the central bore 15. Upon insertion of the locking lug 218 into the first notch 18 a second stop 5 prevents the rotation of the lug 218 in a first direction. To selectively lock lug 218 within the locking profile 16, locking lug 218 travels along a first path 19 until it reaches a first recess 7. As discussed above, the locking lug 218 will depress washer 20 and spring 30 to permit adequate clearance for the lug 218 to travel along path 19. Once within the first recess 7, the spring 30 will bias the washer 20 against the lug 218. Further rotation of the lug 218 out of the first recess 7 is prevented by first stop 8. Likewise, first internal shoulder 9 prevents the inadvertent removal of lug 218 out of first recess 7 until the user pushes on the barrel 200 so that the lug 218 depresses the washer 20 and spring 30 and rotates the lug 218 back across path 19 to first notch 18. The locking profile 16 on the other side of the bore 15 operates in the same manner with a lug 217 traversing a second notch 17, a second path 3 (shown in FIG. 2), and a second recess 4 positioned between a second stop 5 and a second internal shoulder 6.

Figure 5:
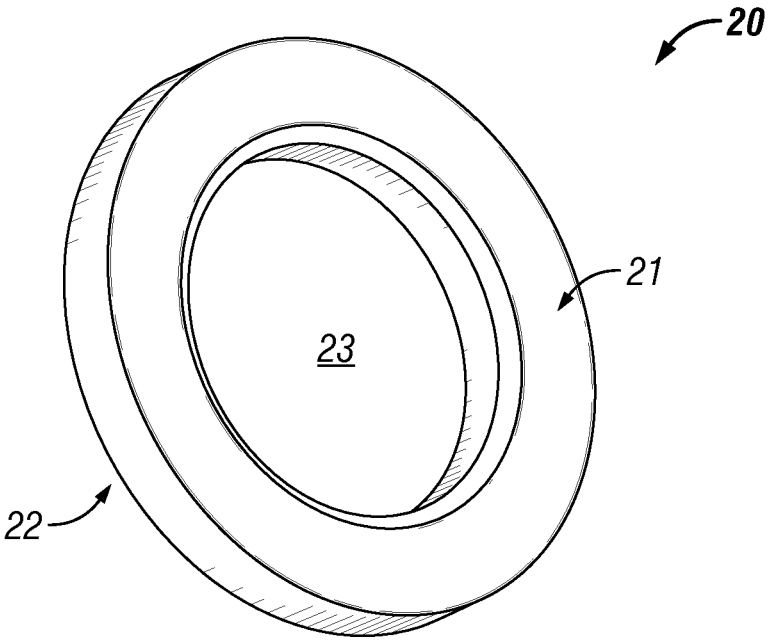
FIG. 5 shows one embodiment of a washer of a quick mount adapter.
Figure 6:
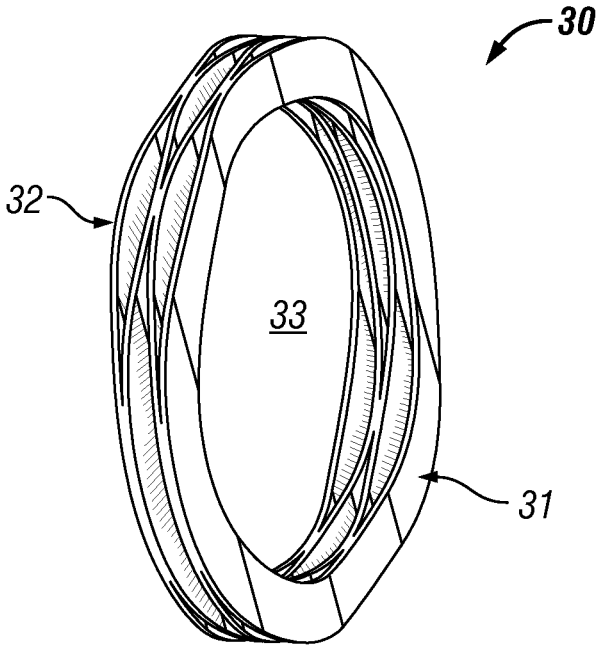
FIG. 6 shows one embodiment of a wave spring of a quick mount adapter.

FIG. 5 shows an isometric view on an embodiment of a washer 20 having a top surface 21, bottom surface 22, and a central opening 23. FIG. 6 shows an isometric view of an embodiment of a wave spring 30 having a top surface 31, bottom surface 32, and a central opening 33.

Figure 7:
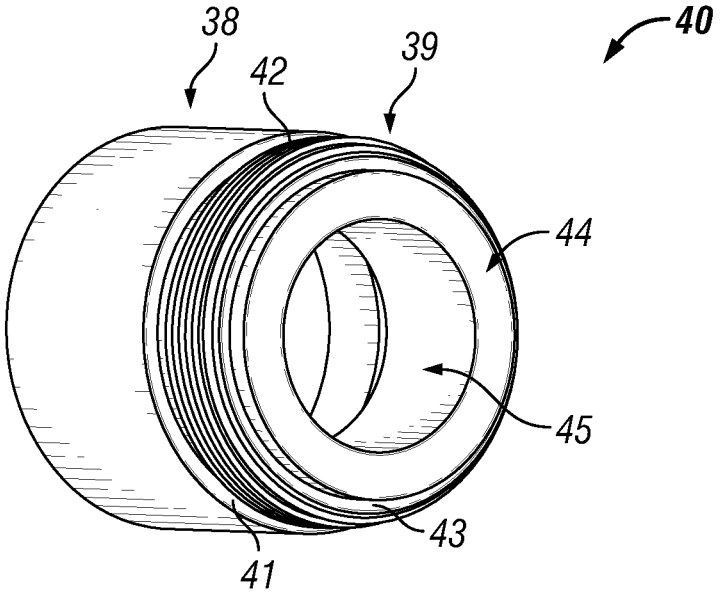
FIG. 7 shows an isometric top view of one embodiment of an adapter base of a quick mount adapter.
Figure 8:
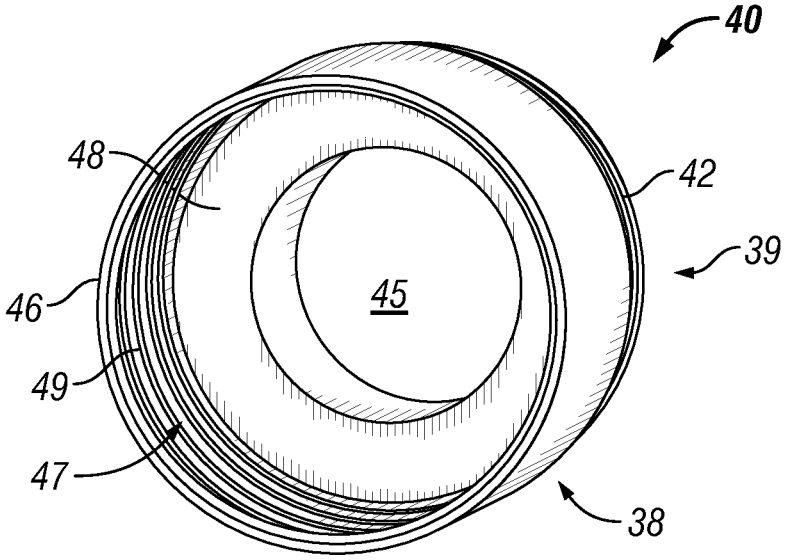
FIG. 8 shows an isometric bottom view of one embodiment of an adapter base of a quick mount adapter.

FIG. 7 shows an isometric view of an embodiment of an adapter base 40 that may be used as a component of the quick mount adapter 100. The adapter base 40 has a lower portion 38 and an upper portion 39. The lower portion 38 may have a larger bore 47 than a bore 45 of the upper portion 39 as illustrated in FIG. 7 and FIG. 8. The interface between the larger bore of the lower portion 38 with the smaller bore of the upper portion 39 may form an internal shoulder 48 as shown in FIG. 8. The internal shoulder 48 may be used to retain the washer 20 and wave spring 30 within the lower portion 38 of the adapter base 40 along with collar 10. The wave spring 30 may be compressed against internal shoulder 48 by the washer 20 during the insertion and removal of a barrel 200 of a firearm from the quick mount adapter 100.

The interface between the upper portion 39 and the lower portion 38 may form a lower external shoulder 41 upon which a portion of a suppressor 300 may engage when connected to the quick mount adapter 100. A portion of the upper portion 39 may include external threads 42 for selective connection to a suppressor 300. The top surface 44 of the adapter base 40 includes a central opening or bore 45. The upper portion 39 may include an upper external shoulder 43 as shown in FIG. 7.

FIG. 8 shows an isometric rear view of an embodiment of an adapter base 40 that includes a central opening or bore 47 in a bottom surface 46. An inner portion of the lower portion 38 may include internal threads 49. As discussed herein, a portion of a collar 10 may be threaded into internal threads 49.

Figure 9:
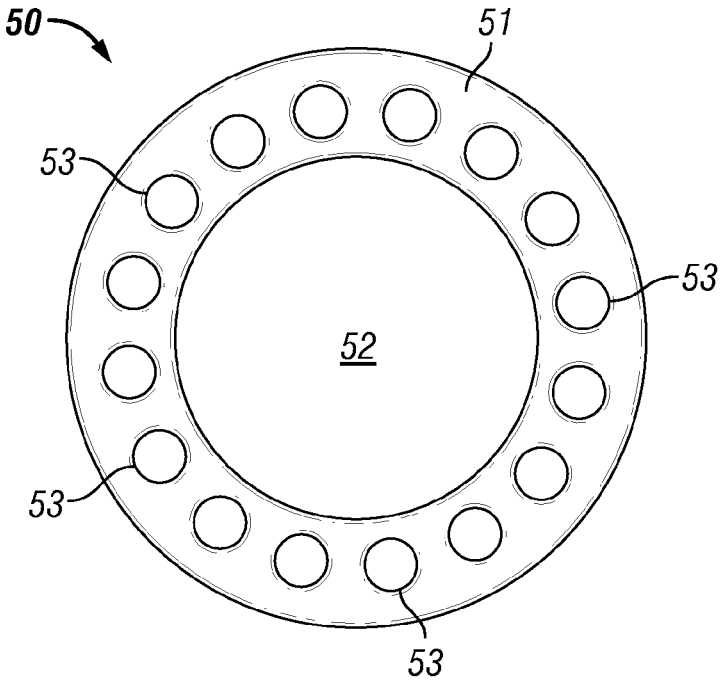
FIG. 9 shows a top view of one embodiment of a spacer of a quick mount adapter.
Figure 10:
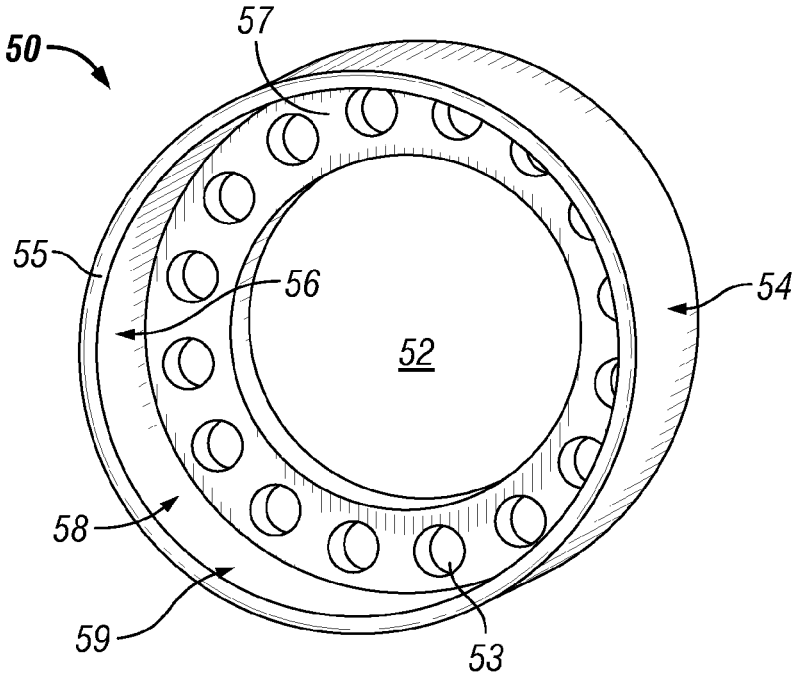
FIG. 10 shows an isometric bottom view of one embodiment of a spacer of a quick mount adapter.

FIG. 9 shows a top view of an embodiment of a spacer 50, which may be a hollow cylinder open at the bottom surface 55 as shown in FIG. 10. The top surface 51 of the spacer 50 may include a plurality of openings or apertures 53 around a central opening 52. The plurality of apertures 53 permits communication to an annular cavity 58 between the central opening 52 and inner surface 56 of the sidewall (shown in FIG. 10) of the spacer 50.

FIG. 10 shows a bottom isometric view of an embodiment of a spacer 50 that is a hollow cylinder open at the bottom surface 55. The opening 59 at the bottom surface 55 of the spacer 50 is much larger than the central opening 52 at the top 51 of the spacer 50. The top surface 51 (shown in FIG. 9) is separated from the bottom surface 55 by a cylindrical sidewall having an inner surface 56 and an outer surface 54. The muzzle break 210 of the barrel 200 will be positioned within the spacer 50 along the central opening 52. The inner surface 56 of the side wall is separated from the central bore 52 by the annular area 58 below the bottom side 57 of the top surface 51. The annular area 58 or gap between the inner surface 56 of the side wall as well as the apertures 53 in the bottom side 57 of the top surface 51 permits the flow of gas out of the spacer 50 during the discharge of the firearm. The configuration of the spacer 50 prevents the buildup carbon between the muzzle break 210 and the quick mount adapter 100.

Figure 11:
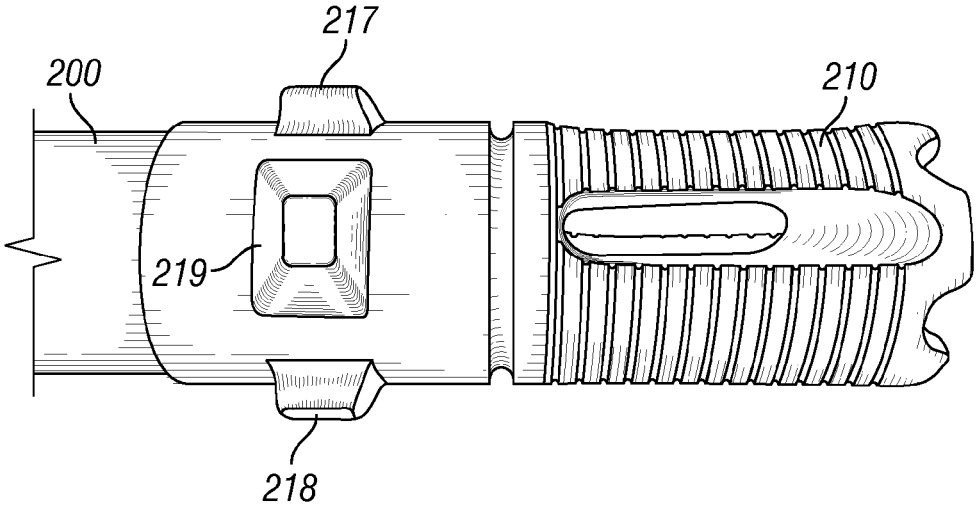
FIG. 11 shows one example of a barrel configured to be used with a quick mount adapter.
Figure 13:
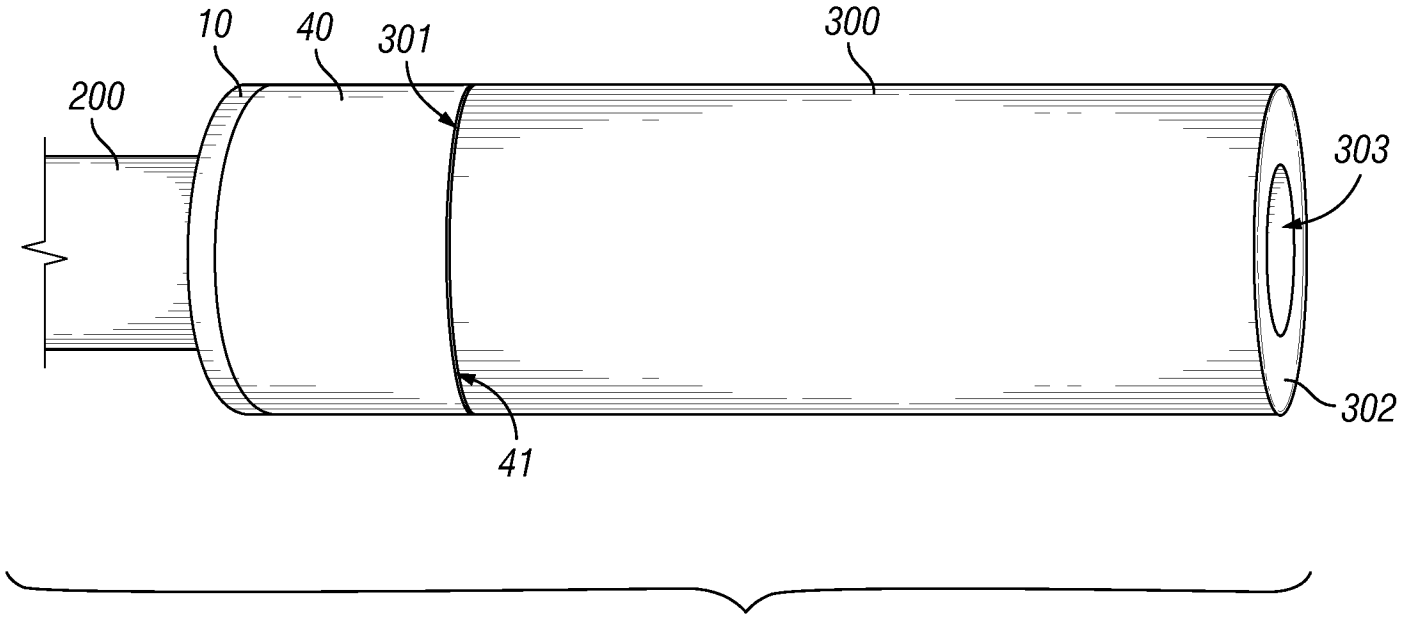
FIG. 13 shows a suppressor connected to a barrel via a quick mount adapter.

FIG. 11 shows an example of a portion of a barrel 200 that may be inserted into the quick mount adapter 100 to provide the rapid attachment or removal of an accessory from the end of the barrel. For example, the quick mount adapter 100 may be connected to a suppressor 300 that then may be rapidly connected to the barrel 200 as shown in FIG. 13. The barrel 200 may include a muzzle break 210 connected to the end of the barrel 200. The muzzle break 210 includes a first locking lug 217 and a second locking lug 218 that may be selectively locked within the quick mount adapted 100 as discussed herein. The muzzle break 210 may include recessed portions 219 positioned opposite locking lugs 217 and 218 as shown herein.

Figure 12:
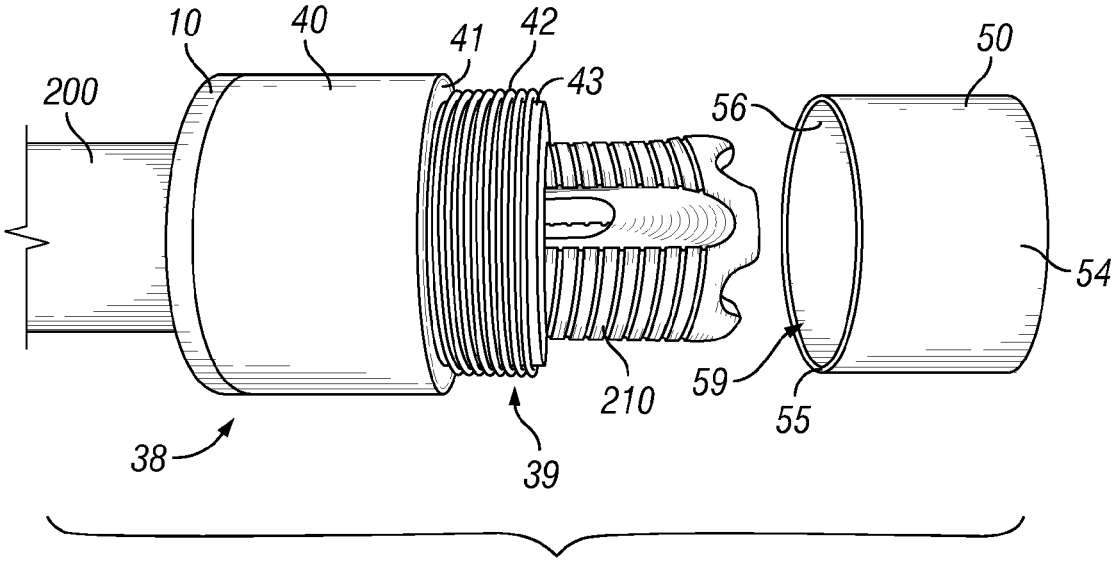
FIG. 12 shows an example of a barrel positioned within a portion of a quick mount adapter.

For illustrative purposes, FIG. 12 shows a barrel 200 and muzzle break 210 inserted into a collar 10 and based adapter 40 of a quick mount adapter 100 with an accessory connected to the base adapter. The spacer 50 has been moved off the base adapter 40 also for illustrative purposes only. The addition of an accessory, such as a suppressor 300, secures the spacer 50 on the base adapter 40.

FIG. 13 shows a first end 301 of a suppressor 300 engaged with a lower external shoulder 41 of the base adapter 40. The second end 302 of the suppressor 300 includes an opening 303 for the departure of a projectile from the suppressor 300. To install a suppressor 300 onto the barrel 200 of a firearm, the suppressor 300 may first be threaded onto the base adapter 40 of the quick mount adapter 100. The quick mount adapter 100 and suppressor 300 assembly may then be rapidly inserted onto the barrel 200 using the locking lugs 217 and 218 as discussed herein. Alternatively, the quick mount adapter 100 may first be installed onto the locking lugs 217 and 218 and an accessory, such as a suppressor 300, may then be threaded onto the base adapter 40 of the quick mount adapter 100.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A quick mount adapter for a firearm comprising:

an adapter base comprising a cylindrical housing having an upper portion and a lower portion, the upper portion having an upper end with an opening in the upper end and the lower portion having a lower end with an opening in the lower end and a cavity within the lower portion of the housing, a portion of the cavity having threads and an exterior portion of the upper portion having threads, and the cylindrical housing having an interface between the upper portion and the lower portion, the interface forming an internal shoulder within the cavity;

a wave spring having a top surface, a bottom surface, and a central opening, the wave spring being positioned within the cavity of the adapter base, the top surface of the wave spring being positioned adjacent the internal shoulder within the cavity;

a washer having a top surface, a bottom surface, and a central opening, the washer being positioned within the cavity of the adapter base, the top surface of the washer being positioned adjacent the bottom surface of the wave spring; and a collar having a top surface, a bottom surface, a central opening, and an internal locking profile, the collar having threads on an external surface between the top surface and the bottom surface, the threads of the collar engaging the threads in the cavity of the adapter base wherein a portion of the collar is positioned within the cavity.

2. The quick mount adapter of claim 1, further comprising a spacer positioned on the upper portion of the adapter base, the spacer comprising:

a cylindrical housing having a top surface and a bottom surface;

a central opening in the top surface;

a plurality of annular openings positioned around the central opening;

an opening in the bottom surface of the cylindrical housing defining a cavity within the cylindrical housing;

wherein the opening of the bottom surface has a larger diameter than a diameter of the central opening in the top surface; and wherein the central opening of top surface defines an annular portion of the cavity.

3. The quick mount adapter of claim 2, wherein the opening in the upper end of the adapter base has a smaller diameter than a diameter of the opening in the lower end of the adapter base.

4. The quick mount adapter of claim 3, the top surface of the adapter base further comprising an upper external shoulder and wherein the interface further defines a lower external shoulder.

5. The quick mount adapter of claim 4, wherein the bottom surface of the spacer is positioned on the upper external shoulder of the adapter base.

6. The quick mount adapter of claim 5, wherein the threads on the exterior portion of the upper portion of the adapter base are below the upper external shoulder.

7. The quick mount adapter of claim 6, wherein the locking profile is configured to selectively connect the adapter base to a locking profile on a barrel.

8. The quick mount adapter of claim 6, wherein the central opening of the collar further comprising a first notch and a second notch.

9. The quick mount adapter of claim 8, wherein the first notch and the second notch are positioned approximately 180 degrees apart around the central opening.

10. The quick mount adapter of claim 9, wherein the internal locking profile of the collar further comprises:

a first internal shoulder, a first path, a first stop, a first recess, a second internal shoulder, a second stop, a second path, and a second recess;

wherein the first path connects the first notch to the first recess;

wherein the second path connects the second notch to the second recess;

wherein the first recess is positioned between the first internal shoulder and the first stop; and wherein the second recess is positioned between the second internal shoulder and the second stop.

11. The quick mount adapter of claim 10, wherein the first internal shoulder and the second stop are each positioned adjacent the first notch and wherein the second internal shoulder and the first stop are each positioned adjacent the second notch.

12. The quick mount adapter of claim 11, wherein the wave spring biases the washer towards the locking profile of the collar to selectively retain a locking profile on a barrel within the first and second recess of the locking profile of the collar.

13. The quick mount adapter of claim 11, wherein the washer may be used to depress the wave spring against the internal shoulder of the adapter base to permit movement of a locking profile on a barrel along the first and second paths of the locking profile of the collar.

14. A suppressor system for a firearm, the system comprising:

an adapter base comprising a cylindrical housing having an upper portion and a lower portion, the upper portion having an upper end with an opening in the upper end and the lower portion having a lower end with an opening in the lower end and a cavity within the lower portion of the housing, a portion of the cavity having threads and an exterior portion of the upper portion having threads, and the cylindrical housing having an interface between the upper portion and the lower portion, the interface forming an internal shoulder within the cavity;

a wave spring having a top surface, a bottom surface, and a central opening, the wave spring being positioned within the cavity of the adapter base, the wave spring configured to have the top surface positioned adjacent to the internal shoulder within the cavity;

a washer having a top surface, a bottom surface, and a central opening, the washer being configured to be positioned within the cavity of the adapter base with the top surface of the washer being positioned adjacent to the bottom surface of the wave spring;

a collar having a top surface, a bottom surface, a central opening, and an internal locking profile, the collar having threads on an external surface between the top surface and the bottom surface, the threads of the collar configured to engage the threads in the cavity of the adapter base to position a portion of the collar within the cavity of the adapter base;

a suppressor housing having a first end and a second end, the first end adapted to be connected to the threads on the exterior portion of the adapter base, the suppressor housing being adapted to suppress a noise during the discharge of a firearm; and a spacer configured to be positioned on an upper exterior shoulder of the adapter base within the suppressor housing, the spacer comprising:

a cylindrical housing having a top surface and a bottom surface;

a central opening in the top surface;

a plurality of annular openings positioned around the central opening;

an opening in the bottom surface of the cylindrical housing defining a cavity within the cylindrical housing;

wherein the opening of the bottom surface has a larger diameter than a diameter of the central opening in the top surface; and wherein the central opening of top surface defines an annular portion of the cavity.

15. The system of claim 14, wherein the interface between the upper portion and the lower portion of the adapter base forms a lower external shoulder and wherein the first end of the suppressor housing abuts the lower external shoulder.

16. The system of claim 15, wherein the central opening of the collar further comprising a first notch and a second notch.

17. The system of claim 16, wherein the internal locking profile of the collar further comprises:

a first internal shoulder, a first path, a first stop, a first recess, a second internal shoulder, a second stop, a second path, and a second recess;

wherein the first path connects the first notch to the first recess;

wherein the second path connects the second notch to the second recess;

wherein the first recess is positioned between the first internal shoulder and the first stop; and wherein the second recess is positioned between the second internal shoulder and the second stop.

18. The system of claim 17, wherein the washer may be used to depress the wave spring against the internal shoulder of the adapter base to permit a first locking lug of a barrel to move along the first path from the first notch to the first recess and to permit a second locking lug of the barrel to move along the second path from the second notch to the second recess.

19. The system of claim 18, wherein the first stop prevents the first lug from moving beyond the first recess and wherein the second lug prevents the second lug from moving beyond the second recess.

20. The system of claim 19, wherein the wave spring biases the bottom surface of the washer against the first and second lugs to selectively retain the first and second lugs within the first and second recesses.

21. A quick mount adapter for a firearm comprising:

an adapter base comprising a cylindrical housing having a first portion, a second portion, and a central bore comprising a first bore through the first portion of the housing and a second bore through the second portion of the housing, the first bore having a smaller inner diameter than the second bore, a portion of the second bore having threads and an exterior portion of the first portion of the housing having threads, and an internal shoulder formed at an interface between the first bore and the second bore;

a biasing mechanism being positioned within the second bore of the adapter base;

a washer, the washer being positioned within the second bore, the biasing mechanism being positioned between the washer and the internal shoulder;

a collar having a central bore and an internal locking profile in the central bore, a portion of the collar being threaded into the second bore to retain the washer and biasing mechanism within the second bore between the collar and the internal shoulder; and a spacer a hollow cylindrical housing having a top surface, a central opening in the top surface, and a plurality of annular openings positioned around the central opening.

22. The quick mount adapter of claim 21, wherein the biasing mechanism is a wave spring.

23. The quick mount adapter of claim 21, wherein the spacer is a portion of the first portion of the adapter base.

* * * * *